US007708425B2

(12) United States Patent
Warhurst

(10) Patent No.: US 7,708,425 B2
(45) Date of Patent: May 4, 2010

(54) REMOVABLE EMERGENCY LIGHT

(76) Inventor: Mark Leslie Warhurst, 1042 High Mountain View Dr., Cedar City, UT (US) 84721

( * ) Notice: Subject to any disclaimer, the term of this patent is extended or adjusted under 35 U.S.C. 154(b) by 0 days.

(21) Appl. No.: 11/677,041

(22) Filed: Feb. 20, 2007

(65) Prior Publication Data

US 2008/0198587 A1 Aug. 21, 2008

(51) Int. Cl.
*F21L 4/08* (2006.01)

(52) U.S. Cl. ..... 362/183; 362/202; 362/208; 362/640

(58) Field of Classification Search ..... 362/183, 362/202, 200, 201, 208, 640, 641, 646, 658, 362/657
See application file for complete search history.

(56) References Cited

U.S. PATENT DOCUMENTS 2,213,584 A * 9/1940 Hulst ..... 362/20
3,014,123 A * 12/1961 Mainzer ..... 40/541
3,735,119 A * 5/1973 Williams, Jr. ..... 362/198
4,486,689 A 12/1984 Davis
5,150,284 A 9/1992 Dobert
5,432,689 A * 7/1995 Sharrah et al. ..... 362/183
5,684,378 A 11/1997 Furth
5,806,961 A 9/1998 Dalton
6,505,952 B1 1/2003 Kish
6,827,468 B2 * 12/2004 Galli ..... 362/294
6,969,181 B1 11/2005 Bailey
7,045,975 B2 5/2006 Evans
7,102,172 B2 * 9/2006 Lynch et al. ..... 257/79
2004/0252497 A1 * 12/2004 Lim ..... 362/202

* cited by examiner

*Primary Examiner*—Sharon E Payne
(74) *Attorney, Agent, or Firm*—Robert Haight

(57) ABSTRACT

A removable emergency light that can be removed from the wall and used as a flashlight. The light is hard wired into a standard power supply and will turn on during a power failure. When the power supply is functioning, batteries in the light are charged. The removable emergency light provides a light source that can be easily located during a power failure, removed and used in multiple locations as desired. The removable emergency light is sized to fit in a standard gang box and can be used with any standard electrical plan.

9 Claims, 5 Drawing Sheets

REMOVABLE EMERGENCY LIGHT

CROSS REFERENCE TO RELATED APPLICATIONS

Not applicable.

FEDERALLY SPONSORED RESEARCH OR DEVELOPMENT

Not applicable.

SEQUENCE LISTING OR PROGRAM

Not applicable.

BACKGROUND

1. Field of Invention

The present invention relates generally to removable emergency lighting, more particularly to a removable emergency light that can be used as a flashlight in case of a power outage.

2. Prior Art

Emergency safety lighting is commonly used to provide light when a power outage occurs. The lights are able to function during a power outage by using batteries that energize a light bulb. This process illuminates the area directly around the light.

Emergency lighting is mainly used in commercial buildings to direct occupants to an exit in the event of a power outage. Emergency lighting is not required or normally used in a personal residence because occupants will usually use a flashlight; also, the cost of placing emergency lighting in a residence is prohibitive because emergency lighting requires special housing and wiring. There are several problems with using a flashlight during a power outage. One is finding a flashlight in the dark and, two, even when a flashlight is found it may not have batteries and would be useless.

U.S. Pat. No. 5,684,378 (1997) teaches a flashlight light that can be plugged into a standard wall socket. Such a device poses a hazard to children who would be attracted to the socket by the flashlight. Because the flashlight sticks out from the wall; it would be in a position to be easily damaged by movement along the wall. Also having a flashlight on the wall may not be compatible with the interior design space.

Patents such as U.S. Pat. No. 6,969,181 (2005) teaches safety lighting that can be hidden and recessed in a wall. Such devices are too costly for the average homeowner and would not provide light to illuminate an area were it was not installed, such as a closet or cabinet.

The prior art lacks an emergency light that can be placed in a standard 22.5 cubic inch, single gang electrical box; be easily wired into a standard electrical system; and be removed in a time of emergency.

BACKGROUND OF INVENTION—OBJECTS AND ADVANTAGES

Accordingly, besides the other objects and advantages that will become apparent, the main objective of the present invention is to have an emergency light that fits into a standard 22.5 cubic inch, single gang electrical box; the light being removable from the gang box to act as a portable light source. In addition, there are other objects and advantages to the present invention which are:

(a) to provide a removable emergency light that can be installed in a 22.5 cubic inch, single gang electrical box. Before now, an emergency flashlight that had the components to sense a power failure was too large to fit in a 22.5 cubic inch, single gang electrical box;

(b) to provide a portable light that can easily be found and used in multiple areas during power failure in a building. This allows a person to use light to look in areas that would not be illuminated by emergency lighting (such as a closet or drawer);

(c) to provide a portable light that is rechargeable and can be used as needed;

(d) to provide an emergency light that is compatible with any interior design space;

(e) to provide a rechargeable flashlight that is recessed within the wall were the lens of the flashlight is flush with the wall, thus eliminating the possibility of snags;

(f) to provide an inexpensive means for having emergency lighting, because the light fits into a 22.5 cubic inch, single gang electrical box and requires no change to a buildings electrical layout, the invention is less expensive to install than current emergency lighting; and (g) to provide an emergency light that can be placed in an existing electrical layout or in a new construction electrical layout.

Further objectives and advantages are to provide a device that can be easily placed anywhere in a building. Because the light fits in a 22.5 cubic inch, single gang electrical box, the device can easily be place in multiple locations in a building. The invention can be easily modified to include a photo cell that would allow it to function as a night light. In addition, the light can be placed in a water proof housing unit and placed outside. The removable emergency light can modified to fit in a camping trailer, utility trailer or RV. This would allow easy access to a charged light that could be used during camping or other outdoor activities. Still further objects and advantages will become apparent from a consideration of the ensuing description and drawings.

SUMMARY

In accordance with the present invention a removable emergency light comprising a housing that fits in a 22.5 cubic inch, single gang electrical box and a removable, portable light that turns on during a power failure.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 1:
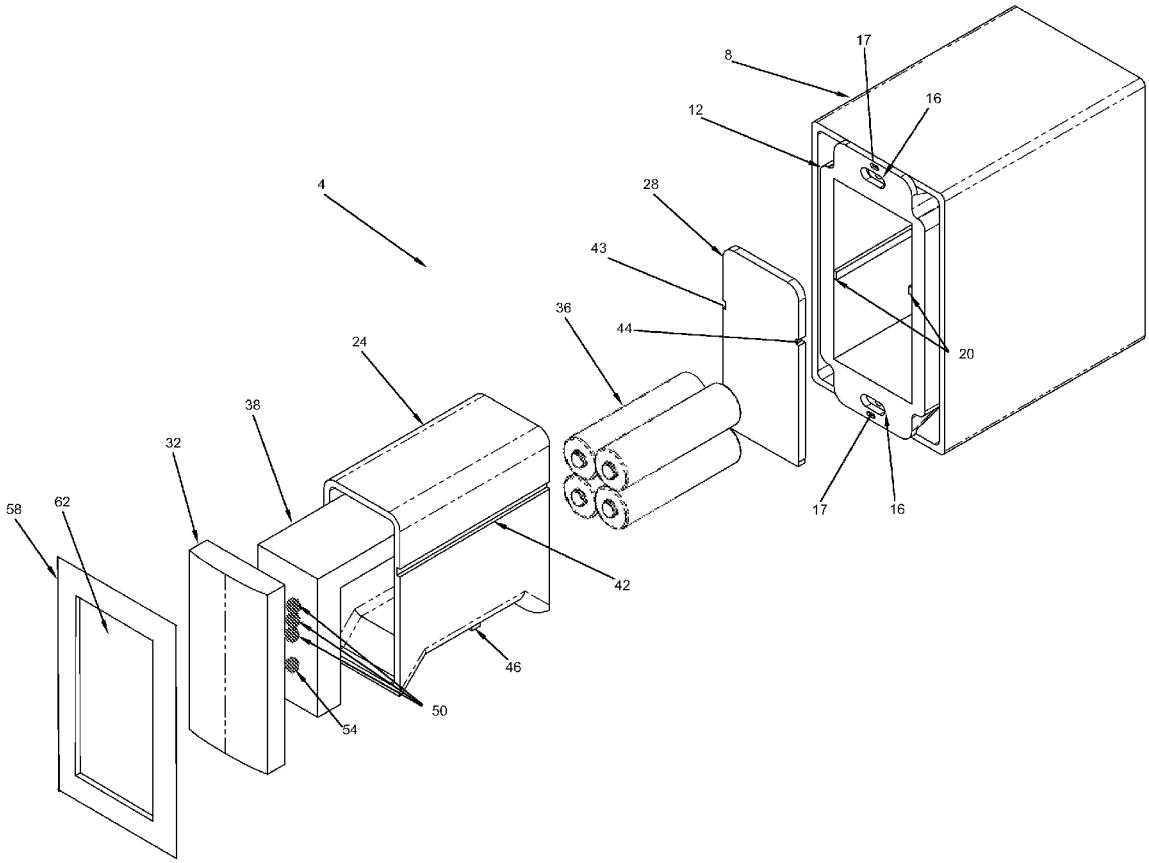
FIG. 1 is a perspective view of the removable emergency light with visible components.

In accordance with FIG. 1 the removable emergency light 4 can be place in a 22.5 cubic inch, single gang electrical box 8. Light casing 12 connects to a gang box 8. Casing 12 can be made from any suitable material but in this embodiment it is made of Lexan Plastic. Screw holes 16 are used to secure casing 12 to the gang box 8. Casing 12 is hard wired into a standard electrical system (see FIG. 4). Flanges 20 are located on both sides of casing 12 and are used to prevent light housing 24 from moving vertically. In addition, flanges 20 are connected to a standard electrical system (see FIG. 4).

Light housing 24 has backing 28 that is used to cover the back side of housing 24 and lens 32 is used to cover the front of light housing 24. Backing 28 and lens 32 are secured in place to keep batteries 36 and circuit panel envelope 38 in light housing 24. Circuit panel envelope 38 is bent at ninety degrees to reduce the size of light housing 24.

Figure 2:
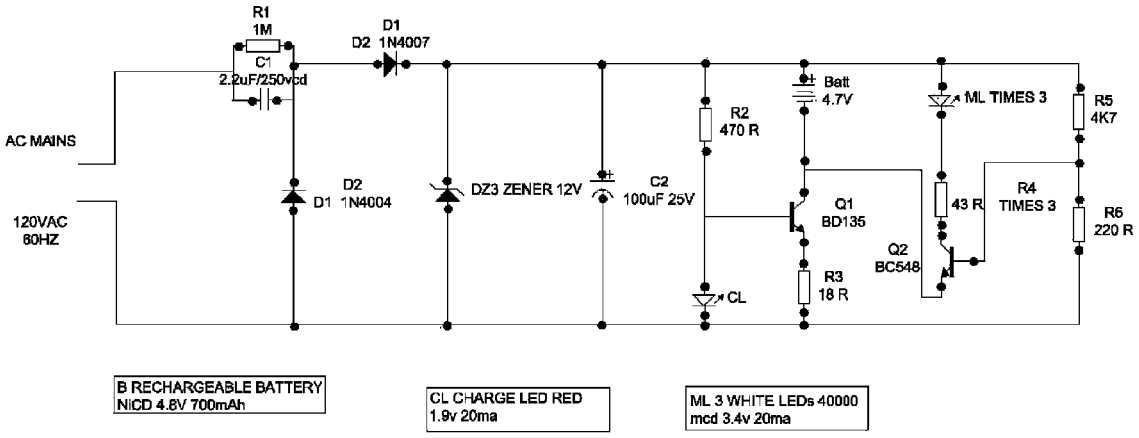
FIG. 2 is the wiring and component diagram.

Circuit panel envelope 38 is a representation of the space occupied by the components on the electrical panel (see FIG. 2). It is to be understood that the components are not enclosed, but are placed on a circuit panel. Bending circuit panel envelope 38 ninety degrees, allows light housing 24 to be small enough to fit into gang box 8. The circuit envelope is typically one inch wide and the vertical portion is typically 2.25 inches tall and the horizontal portion is typically 2.5 inches long.

Groove 42 runs along both sides of light housing 24 and match with flanges 20 on casing 12. Light housing 24 has electrical leads 43 and 44 that mate with the electrical leads in casing 12 (see FIG. 4). This allows current to flow into light housing 24 when placed in casing 12.

A single or plurality of batteries 36 may be used; in this embodiment four rechargeable batteries are used. Switch 46 is used to toggle light emitting diode ("LED") lights 50 on and off. Red LED light 54 indicates when batteries 36 are charging. Red LED light is optional and can be any color. Gang box 8 and Casing 12 are covered with a standard switch plate 58 with opening 62.

Lens 32 is made of clear Lexan Plastic but any suitable clear material can be used. Light housing 24 and backing 28 are made of Lexan Plastic but any suitable material may used. Circuit panel envelop 38 is wired in accordance with FIG. 2 and is composed of material commonly used in the art. Batteries 36 can be any type of standard battery commonly used in the art and in this embodiment they are NiCD 4.8V 700 mAh batteries. Lights 50 can be any type of light but in this embodiment it is 3 white LEDs 40000 mcd 3.4 v 20 ma.

The typical dimensions for the light housing 24 are: length 2.5 inches, width 1.17 inches, height at end 2.5 inches and height in middle 1.9 inches. Light housing 24 is typically made of ⅛ inch thick plastic.

FIG. 2 shows the components of circuitry of the circuit panel envelope (FIG. 1, 38). In this embodiment the circuit panel is designed for a connection to a standard 120 V AC 60 HZ electrical system. This is a standard power supply in most commercial and residential buildings. The circuit operates as follows. When the flashlight is not plugged into an AC outlet, diode D4 prevents any current flow from battery B to Q1. Thus the emitter of Q2 transistor is directly connected to the negative terminal of the battery B and its base is positively polarized through R5. In this way the base-emitter junction of the transistor is directly polarized turning on the collector-emitter junction and allowing current to flow from battery B to ML (main LEDs).

When the flashlight is plugged in to the 120V AC and charging, the charging red 1.9 vdc 20 ma LED indicator (CL) is on while the main LEDs (ML) are off.

Note that Q1 is turned on as the base has a positive supply given by R2 and the charging led CL has a 1.9 junction drop that remains constant, as it behaves as a zener diode Thus the circuit around Q1 configures a constant current supply.

In order to turn off Q2 we need its base-emitter junction forward drop to be lower than 07 volts or even better to have VbeQ2 negative. While charging, the measured voltage at the top of the voltage divider, given by R5 and R6 is around 4.7 volts. Supply voltage is approximately 0.7 volts above, due to D4 forward drop, or around 5.7 volts. At Q1's collector we have 5.4−3.9=8.0 volts. And the voltage divider sets Q2's base at around 0.2 volts. VbeQ2=−0.5 volts inversely polarized and Q2 remains in cut-off. The location of switch 46 is indicated on the wiring diagram.

Figure 3:
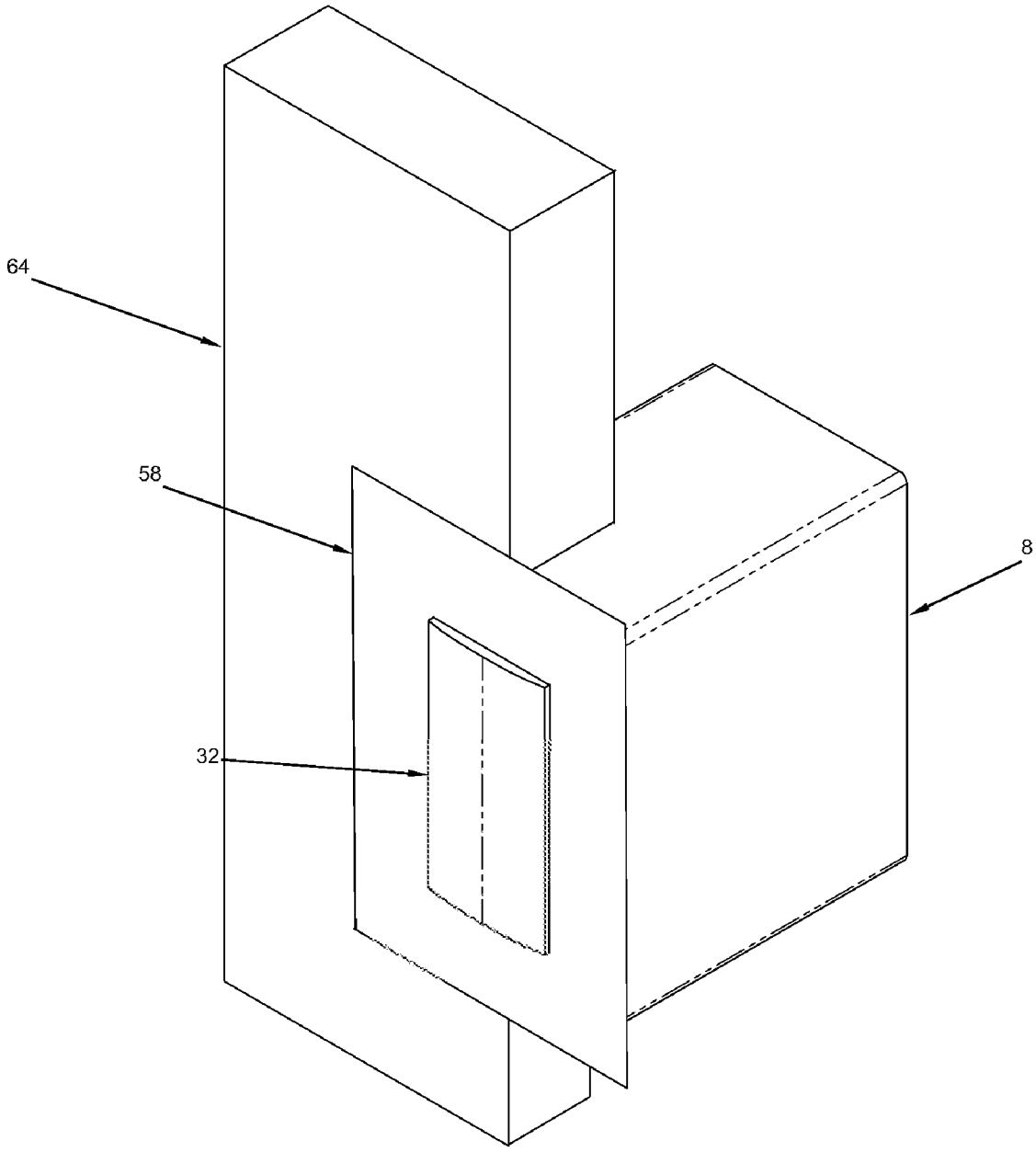
FIG. 3 is a perspective view of the removable emergency light with a partial wall.

FIG. 3 shows the emergency light inside gang box 8. The visible portion of the removable light is lens 32. The remainder of the light is covered by standard switch plate 58 that is flush with wall 64. Gang box 8 is located inside the wall cavity.

Figure 4:
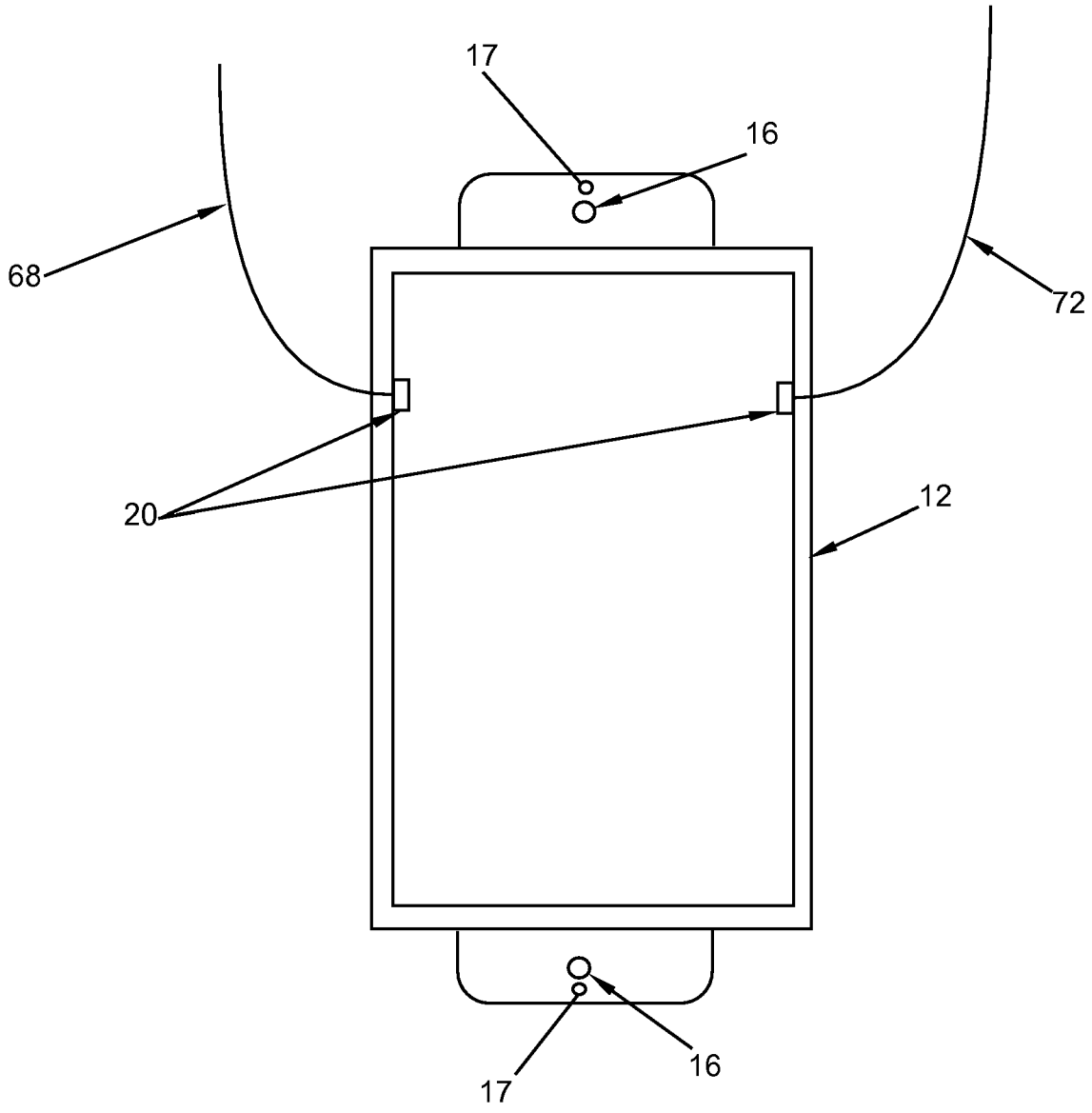
FIG. 4 is a view showing how the unit is wired into a standard electrical system.

FIG. 4 shows how the casing 12 is wired into a standard electrical system. Black wire 68 (power wire) is connected to first flange 20. White wire 72 (neutral wire) is connected to the second flange 20. Any type of standard wire connection such as a pig tail or screws can be used to connect black wire 68 and white wire 72 to casing 12. For this embodiment a pig tail is used. Current is passed into light housing 24 (see FIG. 1) through flanges 20 into leads 43 and 44 (see FIG. 1).

Figure 5:
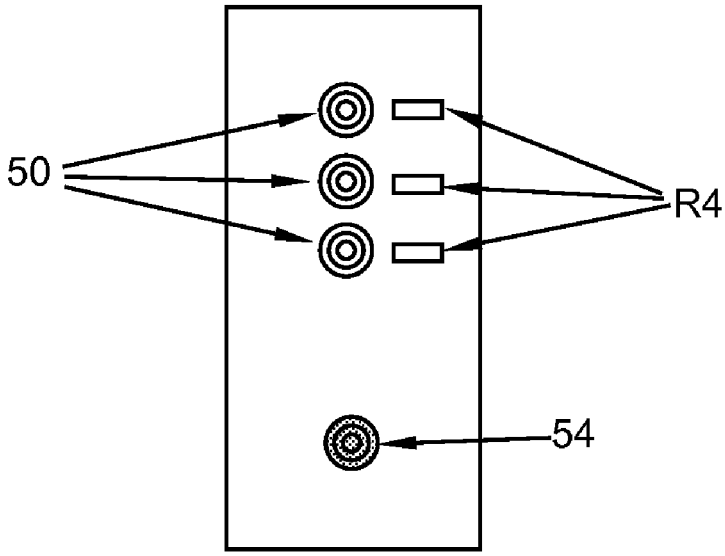
FIG. 5 is a front view of the circuit panel.

FIG. 5 shows a front view of the vertical portion of the circuit panel diagramed in FIG. 3. LED lights 50 are used to provide light and red LED lights 54 turns on when the batteries are charging.

Figure 6:
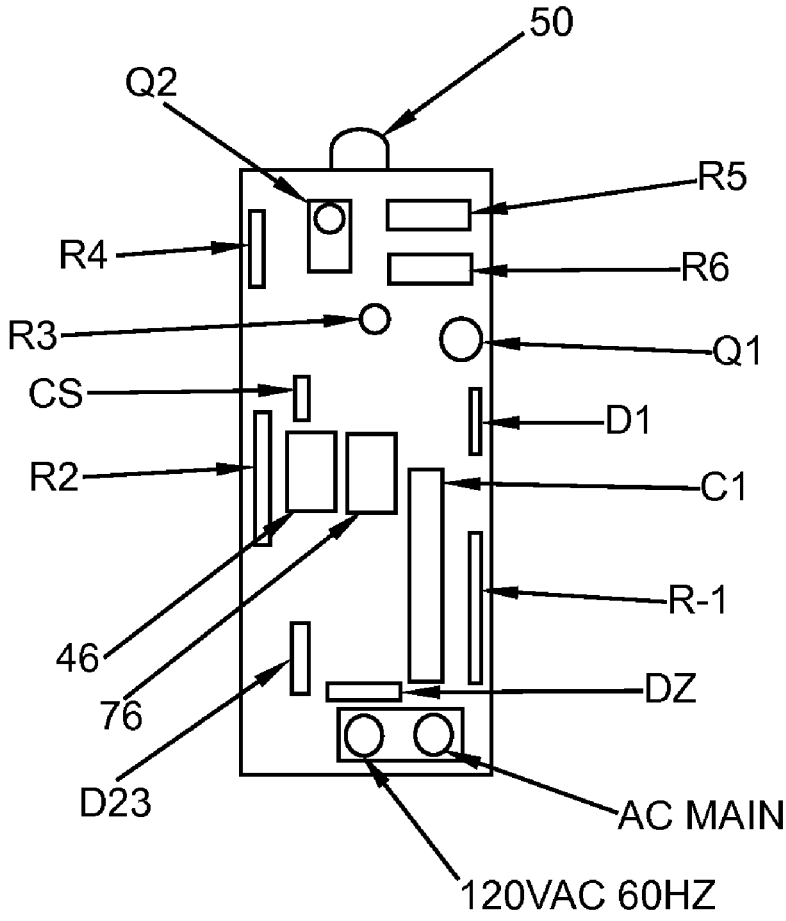
FIG. 6 is a bottom view of the circuit panel.

FIG. 6 shows the underside of the horizontal portion of the circuit panel diagramed in FIG. 2. Battery connection 76 is shown. The other items of the circuit panel are labeled the same as in FIG. 2.

Operation—FIG. 1 and FIG. 3

The manner for using the Removable Emergency Light is as follows. Casing 12 is hard wired into an existing electrical system inside a gang box 8. When light housing 24 is placed in casing 12, the current from a standard power source will charge batteries 36 until they reach full power capacity. While the batteries 36 are charging, Red LED light 54 is on. When the batteries 36 have reached full capacity red LED light 54 turns off.

When power failure occurs the batteries 36 are activated and supply power to turn on lights 50. Light housing 24 can be removed from casing 12. In this embodiment the light casing 12 is pushed, releasing a locking spring (not shown) that pushes light casing 12 partial, through the opening 62 in standard switch plate 58. The locking spring described is a commonly used locking spring where the spring is kept under pressure by a lock until the spring is depressed, releasing the lock. In addition to a locking spring, a plastic clip can be used. When light housing 24 is removed from casing 12, lights 50 can be turned on and off by toggling switch 46. Light housing 24 can be returned to casing 12 through opening 62 to recharge batteries 36. Lights 50 remain off while housing 24 is located inside casing 12 unless a power failure occurs.

From the above description the advantages of the removable emergency light become evident:

(a) to provide a removable emergency light that can be installed in a 22.5 cubic inch, single gang electrical box;

(b) to provide a portable light that can easily be found and used in multiple areas during power failure in a building. This allows a person to use light to look in areas that would not be illuminated by emergency lighting;

(c) to provide a portable light that is rechargeable and can be used as needed;

(d) to provide an emergency light that is compatible with any interior design space;

(e) to provide a rechargeable flashlight that is flush with the wall, thus eliminating the possibility of snags;

(f) to provide an inexpensive means for having emergency lighting, because the light fits into a 22.5 cubic inch, single gang electrical box and requires no change to a buildings electrical layout, the invention is less expensive to install than current emergency lighting;

(g) the light can easily be placed anywhere in a building because of the ability to effortlessly be integrated into a buildings existing electrical plan; and (h) the removable emergency light is an effective low cost alternative to other products currently available on the market.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A removable emergency light comprising:

(a) a portable light having a plurality of sides, the light having a clear lens on a front side through which light shines;

(b) the portable light having electrical contacts which allow a current to flow through the portable light;

(c) a casing with multiple sides, with an opening on one side, the casing sized so the portable light fits completely inside and so that the casing fits completely into a 22.5 cubic inch, single gang electrical box, the opening sized so that the portable light can be removed from the casing through the opening;

(d) the casing having a first set of electrical contact points which contact the electrical contacts on the portable light;

(e) the casing having a second set of contact points connected to an electrical system and the first set of contact points;

(f) the portable light having a battery power source;

(g) the portable light having a switch that toggles the light on and off when the portable light is removed from the casing; and (h) the portable light having a circuit panel that causes the light to go on during a power failure of the electrical system.

2. The removable emergency light in claim 1, wherein said portable light has a first side and a second side with a groove.

3. The removable emergency light in claim 2, wherein said casing has a first side and a second side with a flange that match said grooves.

4. The removable emergency light in claim 1, wherein said portable light can be removed from said casing by activating a locking spring.

5. The removable emergency light in claim 1, wherein said circuit panel is bent at a ninety degree angle.

6. The removable emergency light in claim 1, wherein said circuit panel has a light that indicates when the battery power source is charging.

7. A removable emergency light comprising:

(a) a portable light having a plurality of sides;

(b) the portable light having a first means to allow a current to flow through the portable light, c) a casing with multiple sides, with an opening on one side, the casing sized so the portable light fits completely inside and that the casing fits completely inside a 22.5 cubic inch, single gang electrical box, the opening sized so that the portable light can be removed from the casing through the opening;

(d) the casing having a second means for passing a current into the portable light;

(e) the portable light having a power source;

(f) the portable light having a third means that toggles the light on and off; and (g) the portable light having a fourth means that causes the light to go on during a power failure of the electrical system.

8. The removable emergency light in claim 7, wherein said casing has a fifth means to secure the portable light in the casing.

9. The removable emergency light in claim 7, wherein said portable light has a means for allowing the portable light to be removed from the casing.

* * * * *